United States Patent [19]

Skalle

[11] 4,040,759

[45] Aug. 9, 1977

[54] WARNING, MARKING AND/OR BARRIER ARRANGEMENT

[76] Inventor: Olaf Narten Skalle, Vollebergvn. 32, 1620 Gressvik, Norway

[21] Appl. No.: 719,448

[22] Filed: Sept. 1, 1976

[30] Foreign Application Priority Data

| | | |
|---|---|---|
| Sept. 3, 1975 | Norway | 753024 |
| Aug. 4, 1976 | Norway | 762701 |

[51] Int. Cl.[2] ..... E01F 15/00

[52] U.S. Cl. ..... 404/6; 256/1

[58] Field of Search ..... 404/6, 9, 12; 256/13.1, 256/1

[56] References Cited

U.S. PATENT DOCUMENTS

| | | | |
|---|---|---|---|
| 2,851,935 | 9/1958 | Weeks | 404/13 |
| 3,092,371 | 6/1963 | Knudsen | 256/13.1 |
| 3,114,303 | 12/1963 | Oberbach | 404/6 |
| 3,428,299 | 2/1969 | Mogensen | 256/13.1 |
| 3,476,362 | 11/1969 | Thompson | 256/13.1 |
| 3,591,144 | 7/1971 | Iving | 404/10 X |

*Primary Examiner*—Nile C. Byers

[57] ABSTRACT

A warning, marking and/or barrier arrangement in which trestle barriers, barrier planks and mountings for signboards are combined into units for warning, marking and/or barring purposes. A trestle barrier is constructed of plastic material and has the shape of a hollow double pyramid. The latter has a hollow connecting web, and the parts are arranged on a hollow support. The top of each pyramid has grooves extending in two normal directions. The barrier planks have plugs or recesses at their end portions, as well as holes and/or mountings for the placement of signboards. The mountings are adapted to the grooves in their lowermost portions, and have lugs in their center portions. In the upper portions, the mountings are provided with a hole to which a slide bar is secured. This slide bar has a slot and an upper edge shaped to engage over the edge of a sign board. The top of each pyramid is removably and pivotally mounted on the remaining part of the trestle barrier.

12 Claims, 6 Drawing Figures

WARNING, MARKING AND/OR BARRIER ARRANGEMENT

BACKGROUND OF THE INVENTION

The present invention relates to a novel warning, marking and/or barrier arrangement in which there are provided elements such as trestle barriers or other members for warning, marking and/or barring purposes.

For traffic regulations, detours, road barriers and road work various means are used for barring and marking lanes and pedestrian crossings. For marking alone, mostly relatively small and light plastic cones are used, whereas wooden trestle barriers shaped like sawing horses on which a barrier of planks is arranged are preferably used as continuous barriers for larger areas.

The known barrier means, especially trestle barriers, have several disadvantages. They are not very resistant and require considerable costly maintenance. Another disadvantage of the conventional trestle barriers is that they are much too easily moved or even destroyed when struck by vehicles. Such trestle barriers are, thus, often provided with a ballast of rocks of various kinds. These represent a very serious hazard to a vehicle which, due to some mishap, might strike such a barrier, because one of the rocks might accidentally be thrown into the vehicle.

Accordingly, it is an object of the present invention to provide an arrangement of the foregoing character which is simple in design and construction, and which may be economically fabricated.

Another object of the present invention is to provide a barrier arrangement which is not hazardous to a vehicle and its passengers.

A further object of the present invention is to provide a warning, marking and/or barrier arrangement, as described, which has a substantially long life in service and may be economically maintained while in service.

According to the present invention, a novel barrier has been provided and comprises essentially a novel trestle barrier. According to the invention a trestle barrier made of plastic is, thus, provided. As will appear from the following description and claims the trestle barrier according to the present invention may be molded in one or several pieces. When in multiple pieces, three pieces are preferred. With the trestle barrier according to the invention the above-mentioned disadvantages have been eliminated. The trestle barrier according to the present invention is, furthermore, very inexpensive in production. It can easily be handled and it is most suitable for marking and/or barrier purposes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
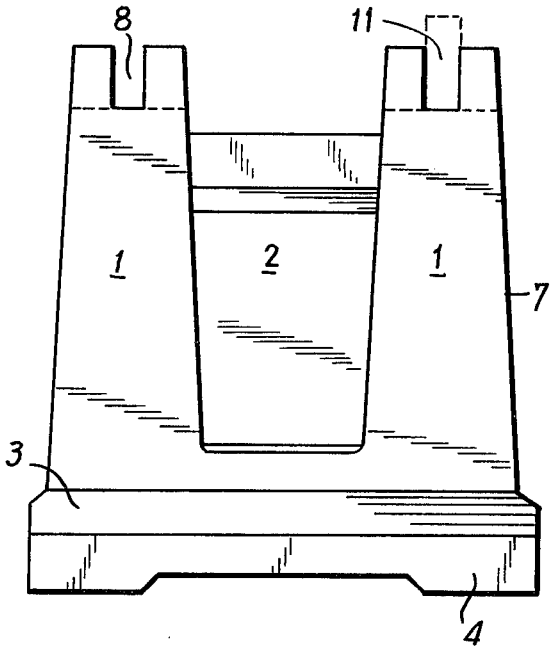
FIG. 1 is a front view of a trestle barrier in accordance with one embodiment of the present invention.

The trestle barrier according to the present invention is preferably provided in two embodiments. According to one embodiment, the trestle barrier is molded in one piece, and this embodiment is disclosed in FIGS. 1 and 2. The trestle barrier 7 according to this embodiment comprises a double pyramid 1. The two pyramids are connected by a web 2 and the parts are arranged on a support 3 to form a unit.

The entire contructions is hollow, which has several advantages besides being material and weight saving. The connecting web 2 has its upper portion shaped as a supporting beam of the same cross sectional shape as the railing bars or planks conventionally used to support conventional removable warning lights to be suspended from the beam or secured to it by screwing. For this purpose the inside of the supporting beam can suitably be reinforced by a short inserted board. The top of the two pyramids or truncated pyramids is provided with grooves 8 extending in two normal directions to receive railing planks 11.

The support 3 is provided with four feet 4 and openings 5, where ballast material, e.g. sand, can be introduced. This last mentioned feature is of great importance, since previously utilized wooden trestle barriers were often provided with ballast in the form of one big rock, or another heavy object placed on the uppermost planks. This resulted in an increased hazard to people in a vehicle that might strike the barrier. The trestle barrier according to the present invention, on the other hand, is quite harmless when struck.

According to another embodiment the trestle barrier according to the invention fundamentally comprises three units. Both top parts 10 of the two pyramids 1 of the trestle barrier, which comprise grooves 8 extending in two normal directions, are, thus, produced separately and removably or pivotally mounted respectively on the remaining part of the trestle barrier. For this purpose, the lower supporting part of the trestle barrier, especially each top of the two pyramid-like lateral parts is provided with a pivot 9. The pivots are adapted to recesses (not shown) in the two parts comprising the grooves.

Figure 2:
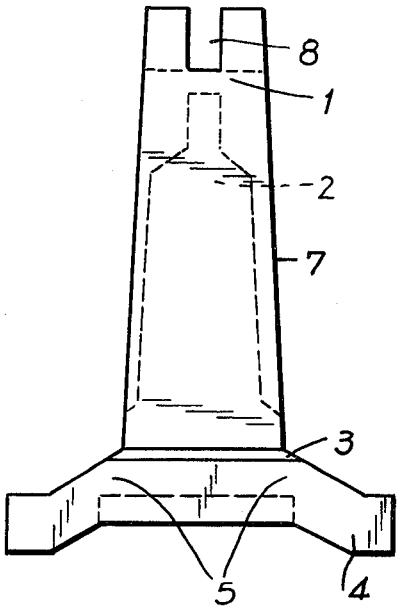
FIG. 2 is an end view of the embodiment of FIG. 1.
Figure 3:
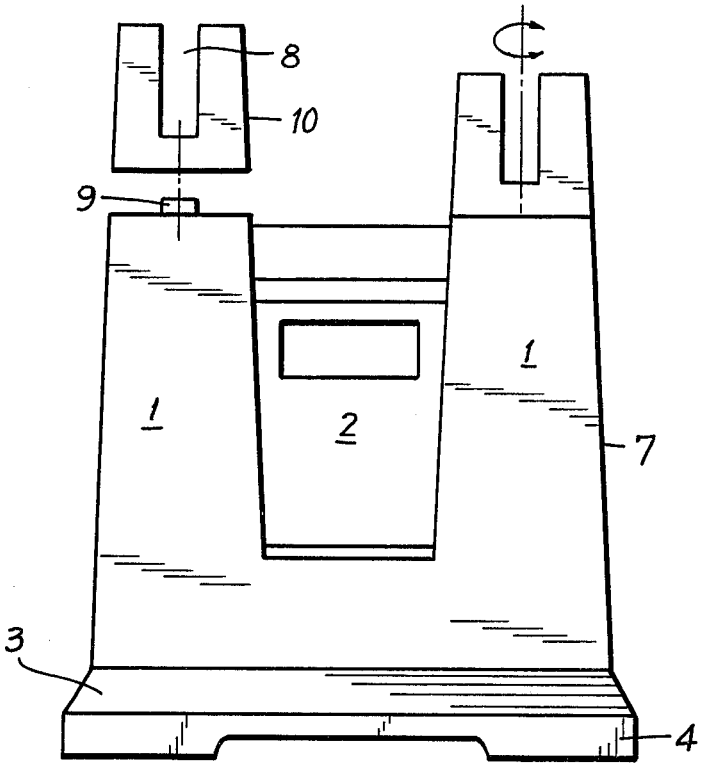
FIG. 3 is an elevational front view of a trestle barrier according to a second embodiment of the present invention.

FIG. 3 is an elevation of the trestle barrier according to the second embodiment, wherein reference numerals 1–4 have the same meaning as in FIGS. 1 and 2. The pivot 9 is adapted for cooperation with a recess (not shown) in the top part 10. The latter has grooves 9 extending in two normal directions.

In a trestle barrier of this embodiment, the top parts 10 are pivotal, which provides for great flexibility in barring, i.e. in placing trestle barriers and arranging barrier planks between the trestle barriers. With the aid of the trestle barriers of this embodiment, planks can be arranged at any desired angles.

Due to their pyramidal shape, trestle barriers 7 according to the present invention can be stacked, which is of great advantage during transport and storage. Due to its large base surface, the present trestle barrier is much more stable than the cones that are much in current use. These can replace these cones in a much more efficient manner for barring area and in cases of road work. The trestle barrier according to the present invention has large lateral surfaces in four directions where reflective materials may be secured and attached, and it is preferably produced in an easily visible color.

Another aspect of the present invention is the provision of further barrier equipment, which can be utilized in a suitable manner, preferably in combination with trestle barriers according to the invention. According to the invention a novel barrier plank is, thus, provided with the special feature that the novel barrier plank bodies are insertable into each other, so that they can be combined to desired lengths.

Figure 4:
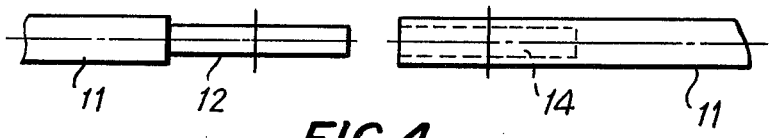
FIG. 4 is a plan view of an embodiment of barrier planks according to the present invention.
Figure 5:
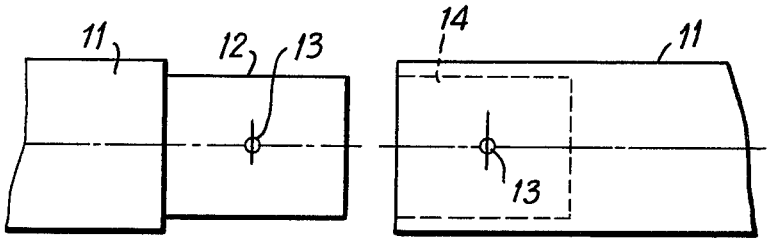
FIG. 5 is a front view of the embodiment of FIG. 4.

FIGS. 4 and 5 disclose a top plan view and an elevation respectively of an embodiment of barrier planks according to the present invention. Each plank 11 can either have its end portion shaped as a plug 12 or it can be provided with a recess 14 adapted to cooperate with the plug 12. For assemblage of barrier planks, a plug 12 is pushed into a recess 14, and the barrier planks can, if desired, be locked together by inserting a bolt or the like into holes 13.

When road lanes and pedestrian crossings, etc. are to be barred or marked, it is usually necessary to use signboards of various kinds. It is, thus, a further object of the present invention to provide a mounting for signboards to be suitably mounted on trestle barriers according to the invention, and if desired, to be combined with barrier planks. In this manner, one trestle barrier can, for instance, be provided with signboards as well as barrier planks.

Figure 6:
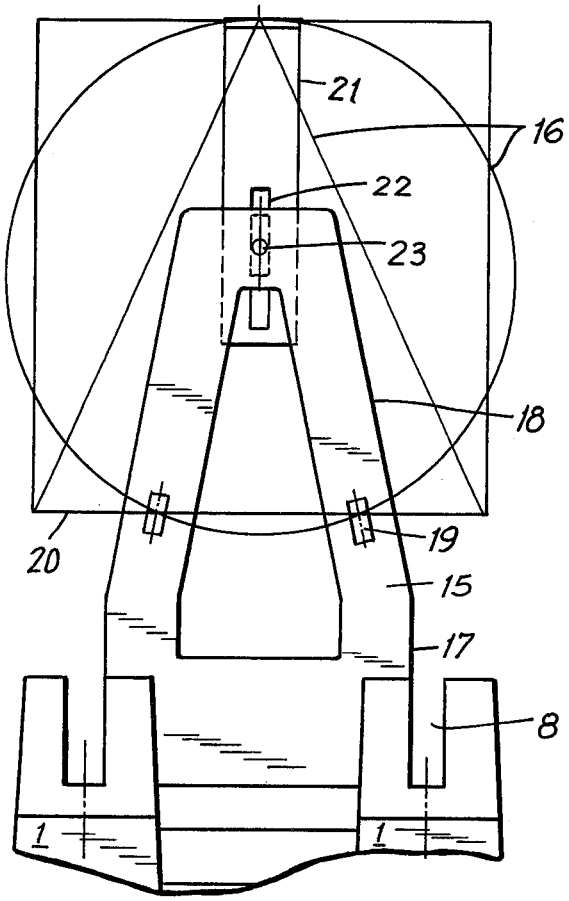
FIG. 6 is a partial view of a mounted embodiment in accordance with the present invention.

FIG. 6 discloses an embodiment of a mounting according to the invention, which satisfies the above requirements. It will be obvious that such a mounting 15 for signboards 16 (indicated in soft lines) could have various geometrical shapes. According to the invention the dimensions of the mounting in its lowermost portion 17, i.e. the portion of said mounting 15 which is placed next to the two parts 10 of the trestle barrier will, however, be determined by the requirement that the width of the mounting at this location should correspond substantially to the width of the grooves 8 in the top parts 10, and that the horizontal length of the portion 17 should correspond to the space between the grooves 8 of the top parts 10, as shown in FIG. 6. According to the invention, and as disclosed in FIG. 6, the mounting 15 is preferably somewhat triangular, and its center portion is provided with a recess. On the converging and vertically extending legs 18, the mounting 15 is provided with lugs 19, which can receive the lower edge 20 of a signboard.

The upper portion of the mounting comprises a slide bar 21 by the aid of which a signboard 16 is urged downwards towards the lugs 19. The top end of the slide bar 21 is shaped so as to engage over the upper signboard edge and, furthermore, is movable in a vertical direction so as to be locked in any desired position adapted to the signboard dimensions. As shown in FIG. 6, this object is achieved by providing the slide bar 21 with a slot 22, so that said slide bar 21 can be locked to the somewhat triangular mounting 15 with the aid of a bolt or the like passed through the hole 23 in the upper portion of said mounting 15.

Without further analysis the foregoing will hopefully reveal the gist of the present invention that others can, by applying current knowledge, readily adapt for various applications without omitting features that, from the standpoint of prior art, fairly constitute essential characteristics of the generic or the specific aspects of this invention. Therefore, such adaptations should and are intended to be comprehended within the meaning and range of equivalents of the following claims.

What is claimed is:

1. A warning, marking and/or barrier arrangement with trestle barriers, barrier planks, and mountings for signboards combinable into units for warning, marking and/or barring purposes, and comprising: a trestle barrier of plastic material and shape of a hollow double pyramid having a hollow connecting web; a hollow support for mounting said pyramid and web; the top of each pyramid having grooves extending in two normal directions; barrier planks having securing elements at their end portions; mounting means for placement of signboard means; said mounting means being in lowermost portions adapted to said grooves, said mounting means having lugs in center portions and having a hole in uppermost portions; a slide bar secured to said hole, said slide bar having a slot and having an upper edge shaped to engage over the edge of a sign board.

2. An arrangement as defined in claim 1 wherein the top of each pyramid is removably and pivotally mounted on the remaining part of the trestle barrier.

3. An arrangement as defined in claim 2 wherein the removable top of a pyramid has a recess in its bottom for pivoting on the truncated pyramid.

4. An arrangement as defined in claim 1 wherein the trestle barrier has substantially large surfaces facing four directions, and reflective means on said surfaces.

5. An arrangement as defined in claim 1 including rib means for reinforcing said hollow connecting web of said trestle barrier; and warning light means supported by said rib means.

6. An arrangement as defined in claim 1 wherein said hollow support has openings for insertion of ballast material.

7. An arrangement as defined in claim 1 wherein said trestle barrier is shaped for stacking in handling and transportation.

8. An arrangement as defined in claim 1 wherein said mounting means comprises a plastic, triangular-shaped member with center portion removed.

9. An arrangement as defined in claim 1 wherein said mounting means has a length of its lower part inserted in said grooves and being substantially less than the space between parallel grooves extending normally to said first-mentioned grooves.

10. An arrangement as defined in claim 1 wherein said securing elements comprise plug means.

11. An arrangement as defined in claim 1 wherein said securing elements comprise recesses.

12. A warning, marking and/or barrier arrangement with trestle barriers, barrier planks, and mountings for signboards combinable into units for warning, marking and/or barring purposes, and comprising: a trestle barrier of plastic material and having two upwardly tapering columns connected together by a web; a hollow support for mounting said columns and web; the top of each column having grooves extending in two normal directions; barrier planks having securing elements at their end portions; mounting means for placement of signboard means; said mounting means being in lowermost portions adapted to said grooves, said mounting means having lugs in center portions and having a hole in uppermost portions; a slide bar secured to said hole, said slide bar having a slot and having an upper edge shaped to engage over the edge of a sign board.

* * * * *